United States Patent [19]

Puchta et al.

[11] Patent Number: 4,839,075

[45] Date of Patent: Jun. 13, 1989

[54] FABRIC-SOFTENING DETERGENT

[75] Inventors: Rolf Puchta, Haan; Hans Nuesslein, Langenfeld; Hannelore Casper, Erkrath, all of Fed. Rep. of Germany

[73] Assignee: Henkel Kommanditgesellschaft auf Aktien, Duesseldorf, Fed. Rep. of Germany

[21] Appl. No.: 151,388

[22] Filed: Feb. 2, 1988

[30] Foreign Application Priority Data

Feb. 2, 1987 [DE] Fed. Rep. of Germany ..... 3702968

[51] Int. Cl.[4] ..... D06M 13/26

[52] U.S. Cl. ..... 252/8.7; 252/548; 252/544; 252/529; 252/525; 252/140; 252/174.25; 252/8.6; 423/328; 8/137

[58] Field of Search ..... 252/110, 8.7, 8.75, 252/8.8, 8.6, 117, 135, 140, 174.25; 8/137

[56] References Cited

U.S. PATENT DOCUMENTS 3,689,424 9/1972 Berg ..... 252/110
3,966,629 6/1976 Dumbrell ..... 252/140

FOREIGN PATENT DOCUMENTS 0026529 5/1984 European Pat. Off. .
1922046 4/1977 Fed. Rep. of Germany .

OTHER PUBLICATIONS

H. Schott, Journal of American Chemical Society, vol. 45, 1968, p. 414.

*Primary Examiner*—A. Lionel Clingman
*Assistant Examiner*—John F. McNally
*Attorney, Agent, or Firm*—Ernest G. Szoke; Wayne C. Jaeschke; Real J. Grandmaison

[57] ABSTRACT

Granular, phosphate-reduced, builder-containing detergent compositions containing a combination of natural layer silicates and fatty acid condensates. The fatty acid condensates are prepared by reaction of fatty acid triglycerides and hydroxyalkyl polyamines. The detergent compositions have an excellent softening effect both at low and high washing temperatures. The compositions provide synergistic softening effects, particularly at low temperatures.

18 Claims, No Drawings

FABRIC-SOFTENING DETERGENT

BACKGROUND OF THE INVENTION

1. Field of the Invention

This invention relates to a phosphate-reduced, granular, builder-containing detergent composition providing improved fabric softening properties through the use of a combination of natural layer silicates and fatty acid condensates obtained by reaction of triglycerides with hydroxyalkyl polyamines.

2. Discussion of Related Art

Phosphate-reduced detergents containing layer silicates as fabric softeners or co-builders are known. For example, European Patent Application No. 26 529 describes a detergent which, in addition to layer silicates, contains anionic surfactants and cationic salts of primary, secondary or tertiary alkylamines or water-soluble quaternary ammonium compounds. The use of surfactant mixtures such as these in detergent formulations can adversely affect the washing result because the cationic and anionic surfactants react undesirably with one another.

According to H. Schott, Journal of American Chemical Society, Vol. 45, 1968, page 414, detergents based on nonionic surfactants and layer silicates do not produce the expected deposition of the layer silicate on cellulose fibers such as cotton for the purpose of softening.

German Patent Application No. 23 34 899 describes granular, builder-containing detergent compositions containing, inter alia, layer silicates. It is known among experts that layer silicates only develop an adequate fabric-softening effect at high temperatures of from 60° C. to 95° C. At lower temperatures, for example in hand washing or in washing with light-duty detergents at 50° C. to 60° C., layer silicates show a distinctly reduced fabric-softening effect.

German Patent No. 19 22 046 describes detergents and washing aids which, in addition to a standard surfactant base, contain as fabric softeners fatty acid condensates obtained by reaction of tri-glycerides of higher fatty acids with hydroxyalkyl polyamine. Fabric softeners such as these develop an adequate fabric-softening effect, particularly at low temperatures, for example in hand washing.

DESCRIPTION OF THE INVENTION

Other than in the operating examples, or where otherwise indicated, all numbers expressing quantities of ingredients or reaction conditions used herein are to be understood as modified in all instances by the term "about".

In contrast to the prior art, the object of the present invention is to provide granular, phosphate-reduced, builder-containing detergent compositions which develop an excellent fabric-softening effect both at low washing temperatures and at high washing temperatures. In the context of the invention, "phosphate-reduced" means that detergents according to the invention contain at most 30% by weight tripolyphosphate, but may also be completely phosphate-free.

According to the invention, this object is achieved by providing granular, phosphate-reduced, builder-containing detergent compositions containing a combination of natural layer silicates and fatty acid condensates.

It has surprisingly been found that, where a combination of natural layer silicates and fatty acid condensates obtained by reaction of fatty acid triglycerides and hydroxyalkyl polyamines is used in granular, phosphate-reduced, builder-containing detergent compositions, the two constituents of the combination develop a synergistic, i.e. superadditive, effect.

Accordingly, the present invention relates to granular, phosphate-reduced, builder-containing detergent compositions which are characterized in that they contain a combination of;

(a) from 4 to 20% by weight natural layer silicates, and (b) from 0.3 to 10% by weight fatty acid condensates obtained by reaction of fatty acid triglycerides with hydroxyalkyl polyamines, based on the weight of the detergent compositions.

The advantage of the combination according to the invention lies in particular in the fact that the fabric-softening effect is developed both at low temperatures, for example in hand washing, and at high temperatures.

In one embodiment of the present invention, granular, phosphate-reduced, builder-containing detergent compositions are characterized in that they preferably contain from 5 to 15% by weight natural layer silicates.

In column 4, under the heading "clay compounds", German Patent No. 23 34 899 describes the natural layer silicates on which the combinations of the detergent compositions according to the invention are based. Specific reference is made both to this list of layer silicates and also to the list of bentonites (smectites) in European Patent Application No. 26 529. In addition, particular preference is attributed in accordance with the invention to natural layer silicates selected from the group consisting of montmorillonites, volchonskoites, neutronites, hectorites, smectites and sauconites.

Where more than 6% by weight fatty acid condensates are used in the combinations according to the invention, the detergency of the detergent compositions may decrease. Accordingly, one preferred embodiment of the present invention is characterized in that the combination preferably contains from 1 to 6% by weight fatty acid condensates. A content such as this of fatty acid condensates is particularly suitable for the use of the detergent compositions according to the invention in light-duty detergents at temperatures of from 40° C. to 60° C. However, where the detergent compositions according to the invention are used for hand washing, the combination preferably contains up to 10% by weight of the fatty acid condensates.

In one preferred embodiment, the granular, phosphate-reduced, builder-containing detergent compositions are characterized in that the ratio by weight of the combination of natural layer silicates of fatty acid condensates is adjusted to between 5:1 and 1:2. Through the adjustment of the ratio by weight of said components in accordance with the invention, an excellent fabric-softening effect of the detergent compositions according to the invention is obtained both at low and high temperatures.

The fatty acid condensates used in the detergent composition according to the invention normally contain fatty acid triglycerides because the fatty acid condensates are prepared by reaction of fatty acid triglycerides with hydroxyalkyl polyamine. The fatty acid condensates are normally prepared by reaction of triglycerides of higher fatty acids containing from 8 to 24 carbon atoms per at least 50% of which contain 16 to 24 carbon atoms per fatty acid group with hydroxyalkyl polyamines containing at least two hydrogen atoms attached to nitrogen, with the proviso that, for each primary and secondary amino group and each hydroxyl group present in the hydroxyalkyl polyamine, ⅓ mole of fatty acid triglyceride is reacted per mole of hydroxyalkyl polyamine in the reaction. The preparation of fatty acid condensates such as these and their contents of fatty acid triglyceride is disclosed in German Patent No. 19 22 046, incorporated by reference in the present specification.

Granular, phosphate-reduced, builder-containing detergent compositions according to this invention are preferably characterized in that the fatty acid condensates is prepared by the reaction of 1 mole of hardened tallow and 1 mole of hydroxyethyl ethylene-diamine.

Detergent compositions according to this invention preferably contain less than 20% by weight phosphates. Since efforts to control environmental pollution presuppose a substantial reduction in the phosphate content of detergent compositions, a preferred embodiment of the present invention is characterized in that the granular, phosphate-reduced, builder-containing detergent compositions are phosphate-free.

The combination according to this invention of natural layer silicates and fatty acid condensates may be incorporated by conventional methods for the production of detergents, for example by hot spraying together with other detergent components, by granulation together with solid and/or liquid detergent constituents, or by subsequent application to solid detergent constituents (for example spray-dried powder, granulate, zeolite, layer silicate). In one particularly preferred variant of the preparation process, the combination of natural layer silicates and fatty acid condensates is prepared by spraying the fatty acid condensates onto the natural layer silicates. The combination thus prepared may then be added to known detergents as detergent additives. Accordingly, the present invention also relates to a detergent additive of (a) natural layer silicate and (b) fatty acid condensate in a ratio by weight of from 5:1 to 1:2. According to the invention, the combination according to the invention is preferably used as a detergent additive in light-duty detergents and/or neutral detergents.

In addition to the combination of natural layer silicates of fatty acid condensates, detergent compositions according to the invention may contain other builders, matrix materials, surfactants, soaps, non-surfactant foam inhibitors and soil carriers.

The builder constituents which may be present in the detergents according to the invention are described in more detail in the following.

Suitable organic and inorganic builder substances include salts which show a mildly acidic, neutral or alkaline reaction, more especially alkali metal salts which are capable of precipitating or complexing calcium ions. Among the inorganic salts, the water-soluble alkali metal metaphosphates and alkali metal polyphosphates, more especially pentasodium triphosphate, in addition to the alkali metal orthophosphates and alkali metal pyrophosphates are of particular importance. These phosphates may be completely or partly replaced by organic complexing agents for calcium ions. These include compounds of the aminopolycarboxylic acid type, such as for example, nitrilotriacetic acid (NTA), ethylenediamine tetra-acetic acid, diethylenetriamine penta-acetic acid and higher homologs. Suitable phosphorus-containing organic complexing agents include the water-soluble salts of alkane polyphosphonic acids, amino- and hydroxyalkane polyphosphonic acids and phosphonopolycarboxylic acids, such as for example methanediphosphonic acid, dimethylaminomethane-1,1-diphosphonic acids, aminotrimethylene triphosphonic acid, 1-hydroxyethane-1, 1-diphosphonic acid, 1-phosphonethane-1,2-dicarboxylic acid, and 2-phosphonobutane-1,2,4-tricarboxylic acid.

Among the organic matrix materials, the nitrogen- and phosphorus-free polycarboxylic acids which form complex salts with calcium ions, including carboxyl-containing polymers are of particular importance. Suitable polycarboxylic acids such as these include, for example, citric acid, tartaric acid, benzenehexacarboxylic acid and tetrahydrofuran tetracarboxylic acid. Also suitable are polycarboxylic acids containing ether groups, such as 2,2'-oxydisuccinic acid and polyhydric alcohols completely or partly etherified with glycolic acid or hydroxycarboxylic acids, for example biscarboxymethyl ethylene glycol, carboxyoxysuccinic acid, carboxy methyl tartronic acid and carboxymethylated or oxidized polysaccharides. Polymeric carboxylic acids having a molecular weight of from 350 to about 1,500,000 in the form of water-soluble salts are also suitable. Particularly preferred polymeric carboxylates have a molecular weight of from 500 to 175,000, and more especially from 10,000 to 100,000. These compounds include, for example, polyacrylic acid, polyhydroxyacrylic acid, polymaleic acid and copolymers of the corresponding monomeric carboxylic acids with one another or with ethylenically unsaturated compounds, such as vinyl methyl ether. The water-soluble salts of polyglyoxylic acid are also suitable.

Suitable water-insoluble inorganic matrix materials include the finely-divided, synthetic sodium aluminosilicates containing bound water of the zeolite A type which are described in detail as phosphate substitutes for detergents and cleaning preparations in German Patent Application No. 24 12 837.

The cation-exchanging sodium aluminosilicates are used in the usual hydrated, finely crystalline form, i.e. they contain hardly any particles larger than 30 μm and preferably comprise a level of at least 80% of particles smaller than 10 μm in size. Their calcium binding power, as determined in accordance with German Patent Application No. 24 12 837, is between 100 and 200 mg CaO/g. Zeolite NaA is particularly suitable, as is zeolite NaX and mixtures of NaA and NaX.

Suitable inorganic, non-complexing salts include the alkali salts, also known as "washing alkalis", of the bicarbonates, carbonates, borates, sulfates and silicates. Of the alkali silicates, sodium silicates in which the ratio of $Na_2O$ to $SiO_2$ is from 1:1 to 1:3.5 are particularly preferred.

Other matrix materials which, by virtue of their hydrotropic properties, are generally used in liquid formulations include the salts of the non-capillary-active $C_2$–$C_9$ sulfonic acids, carboxylic acids and sulfocarboxylic acids, for example the alkali metal salts of alkane, benzene, toluene, xylene or cumene sulfonic acids, sulfobenzoic acid, sulfophthalic acid, sulfoacetic acid, sulfosuccinic acid and the salts of acetic acid or lactic acid. Acetamides and ureas are also suitable solubilizers.

Surfactants which may be present as further components in the detergents and cleaning preparations according to the invention contain at least 1 hydrophobic organic radical and a water-solubilizing anionic, zwitter-ionic or nonionic group in the molecule. The hydrophobic radical is generally an aliphatic hydrocarbon radical containing from 8 to 26, preferably from 10 to 22 and more preferably from 12 to 18 carbon atoms or an alkyl aromatic radical containing from 6 to 18 and preferably from 8 to 16 aliphatic carbon atoms.

Suitable anionic surfactants include, for example, soaps of natural or synthetic, preferably saturated fatty acids, optionally even of resinic or naphthenic acids. Suitable synthetic anionic surfactants include those of the sulfate, sulfonate and synthetic carboxylate type.

Suitable surfactants of the sulfonate type include $C_9$–$C_{15}$ alkyl benzenesulfonates olefin sulfonates, i.e. mixtures of alkene and hydroxyalkane sulfonates and also disulfonates of the type obtained for example from $C_{12}$–$C_{18}$ monoolefins containing a terminal or internal double bond by sulfonation with gaseous sulfur trioxide and subsequent alkaline or acidic hydrolysis of the sulfonation products.

Also suitable are the alkane sulfonates obtainable from $C_{12}$–$C_{18}$ alkanes by sulfochlorination or sulfoxidation and subsequent hydrolysis or neutralization or by bisulfite addition to olefins and also the esters of $\alpha$-sulfofatty acids, for example the $\alpha$-sulfonated methyl or ethyl esters of hydrogenated coconut oil, palm kernel oil or tallow fatty acids.

Suitable surfactants of the sulfate type include the sulfuric acid monoesters of primary alcohols of natural and synthetic origin, i.e. of fatty alcohols, such as coconut oil fatty alcohol, tallow fatty alcohol, oleyl alcohol, lauryl, myristyl, palmityl or stearyl alcohol, or the $C_{10}$–$C_{20}$ oxoalcohols, and those of secondary alcohols having the same chain length. The sulfuric acid monoesters of aliphatic primary alcohols ethoxylated with from 1 to 6 moles of ethylene oxide or of ethoxylated secondary alcohols or alkylphenols are also suitable. Sulfated fatty acid alcohol amides and sulfated fatty acid monoglycerides are also suitable.

Other suitable anionic surfactants include the fatty acid esters and amides of hydroxy- or aminocarboxylic acids or sulfonic acids, such as for example fatty acid sarcosides, glycolates, lactates, taurides or isethionates.

The anionic surfactants may be used in the form of their sodium, potassium and ammonium salts, and as soluble salts of organic bases, such as mono-, di- or triethanolamine.

Suitable nonionic surfactants include the adducts of from 1 to 40 and preferably from 2 to 20 moles of ethylene oxide with 1 mole of a compound containing from 10 to 20 carbon atoms selected from the group consisting of alcohols, alkylphenols and fatty acids. Of particular importance are the adducts of from 8 to 20 moles of ethylene oxide with primary alcohols, for example with coconut oil or tallow fatty alcohols, with oleyl alcohol, with oxoalcohols or with secondary alcohols containing from 8 to 18 and preferably from 12 to 18 carbon atoms and also with mono- or dialkylphenols containing from 6 to 14 carbon atoms in the alkyl radicals. In addition to these water-soluble nonionics, however, completely or substantially water-insoluble polyglycol ethers containing from 2 to 7 ethylene glycol ether groups in the molecule are of interest, particularly where they are used together with water-soluble nonionic or anionic surfactants.

Other suitable nonionic surfactants include the water-soluble adducts containing from 20 to 250 ethylene glycol ether groups and from 10 to 100 propylene glycol ether groups, of ethylene oxide with polypropylene glycol, alkylene diamine polypropylene glycol and with alkyl polypropylene glycols containing from 1 to 10 carbon atoms in the alkyl chain in which the polypropylene glycol chain acts as the hydrophobic radical. It is also possible to use nonionic surfactants of the amine oxide or sulfoxide type, for example the compounds N-cocosalkyl-N,N-dimethylamine oxide, N-hexadecyl-N,N-bis-(2,3-dihydroxypropyl)-amine oxide, N-tallowalkyl-N,n-dihydroxyethylamine oxide. N-alkoxylated fatty acid amides are not regarded as nonionic surfactants in the context of the present invention.

The zwitter-ionic surfactants optionally used are preferably derivatives of aliphatic quaternary ammonium compounds in which one of the aliphatic radicals consists of a $C_8$–$C_{18}$ radical while another contains an anionic, water-solubilizing carboxy, sulfo or sulfato group. Typical representatives of surface-active betaines such as these include, for example, the compounds 3-(N-hexadecyl-N,N-dimethylammonio)-propanesulfonate; 3-(N-tallow alkyl-N,N-dimethylammonio)-2-hydroxypropanesulfonate; 3-(N- hexadecyl-N,N-bis-(2-hydroxyethyl)-ammonio)-2-hydroxypropylsulfate; 3-(N-cocosalkyl-N,N-bis-(2,3-dihydroxypropyl)-ammonio)-propanesulfonate; N-tetradecyl-N,N-dimethylammonioacetate; N-hexadecyl-N,N-bis-(2,3-dihydroxypropyl)-ammonioacetate.

Reduced foaming power, which is desirable where the detergent compositions according to the invention are used in machines, is obtained, for example, by the joint use of soaps. With soaps, foam inhibition increases with the degree of saturation and the C-chain length of the fatty acid ester. Soaps of saturated and unsaturated $C_{12}$–$C_{24}$ fatty acids are therefore particularly suitable foam inhibitors.

The non-surfactant foam inhibitors are generally water-insoluble, mainly aliphatic compounds containing $C_8$–$C_{22}$ hydrocarbon radicals. Suitable non-surfactant foam inhibitors include, for example, the N-alkylaminotriazines, i.e. reaction products of 1 mole of cyanuric chloride with from 2 to 3 moles of a mono- or dialkylamine containing from 8 to 18 carbon atoms in the alkyl radical. Also suitable are propoxylated and/or butoxylated aminotriazines, for example the reaction products of 1 mole of melamine with 5 to 10 moles of propylene oxide and, in addition, 10 to 50 moles of butylene oxide, and the aliphatic $C_{18}$–$C_{40}$ ketones, such as for example stearone, fatty ketones of hardened train oil fatty acid or tallow fatty acid and also paraffins and halogen paraffins melting below 100° C. and silicone oil emulsions based on polymeric organosilicon compounds.

The detergents according to the invention may also contain bleaches and bleach acivators. Among the compounds yielding $H_2O_2$ in water which are used as bleaches, sodium perborate tetrahydrate ($NaBO_2.H_2O_2.3\ H_2O$) and the monohydrate ($NaBO_2.H_2O_2$) are of particular importance. However, other $H_2O_2$-yielding borates may also be used, for example perborax $Na_2B_4O_7.4H_2O_2$. These compounds may be completely or partly replaced by other active oxygen carriers, more especially by peroxypyrophosphates, citrate perhydrates, urea/$H_2O_2$ or melamine/$H_2O_2$ compounds, and by $H_2O_2$-yielding peracidic salts, such as for example caroates ($KHSO_5$), perbenzoates or peroxyphthalates.

Since the detergents according to the invention are particularly suitable for washing at low washing temperatures, activator-containing bleach components are preferably incorporated therein. Certain N-acrylic and O-acyl compounds which form organic per-acids are used as activators for per compounds yielding $H_2O_2$ in water. Suitable compounds include, inter alia, N-diacylated and N,N-tetra-acylated amines, such as for example N,N,N,N,-tetra-acetyl methylenediamine or ethylenediamine and tetra-acetyl glycoluril.

The detergents and cleaning preparations may contain as a further component a soil carrier which suspends the soil detached from the fibers in the wash solution and thus prevents its redeposition. Suitable soil carriers include water-soluble, generally organic colloids, such as for example the water soluble salts or polymeric carboxylic acids, glue, gelatin, salts of ether carboxylic acids or ether sulfonic acids of starch or cellulose, or salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches etc. Polyvinyl pyrrolidone may also be used.

EXAMPLE I

A mixture of the following composition, in % by weight, was prepared. In the following, "EO" stands for moles of ethylene oxide.

7.0% alkyl benzenesulfonate,
4.0% $C_{15}$–$C_{18}$ fatty alcohol-5 EO/$C_{16}$–$C_{18}$ fatty alcohol-10 EO (50 : 50),
1.0% $C_{12}$–$C_{18}$ fatty acid, Na salt,
1.4% polycarboxylic acid,
3.5% waterglass, ratio $Na_2O$: $SiO_2$=3.35,
0.7% cellulose ether mixture,
0.3% perfume,
0.2% protease,
16.0% tripolyphosphate,
15.0% layer silicate (altonite),
5.0% fatty acid condensate, and the balance, sodium sulfate, water and salts.

The polycarboxylic acid used was a copolymer of acrylic acid and maleic acid with an average molecular weight of 70,000 (Sokalan CP 5 ®, BASF) in the form of the sodium salt.

The fatty acid condensate was prepared from hardened beef tallow and n-hydroxyethyl ethylenediamine in accordance with German Patent Application No. 19 22 046, column 17, line 67 et seq. Accordingly, the fatty acid condensate had the composition indicated in said application.

Washing tests were carried out with the detergent composition described above.

Test fabrics of molleton/terry or polyester fibers artificially soiled with dust/sebum were washed with normally soiled domestic washing at 40° C. and 60° C., and wool at 30° C. in an automatic domestic drum-type washing machine (Miele W 433) using the "delicates" and "woolens" programs. Detergency was determined by measurement of the remission, while the softness of the washed and dried fabrics was feel-tested by five experienced examiners.

EXAMPLE II

A mixture of the following composition, in % by weight, was prepared. In the following, "EO" stands for moles of ethylene oxide.

7.0% alkyl benzenesulfonate,
4.0% $C_{15}$–$C_{18}$ fatty alcohol-5 EO/$C_{16}$–$C_{18}$ fatty alcohol-10 EO (50 : 50),
1.0% $C_{12}$–$C_{18}$ fatty acid, Na salt,
1.4% polycarboxylic acid,
3.5% waterglass, ratio $Na_2O$: $SiO_2$=3.35,
0.7% cellulose ether mixture,
0.3% perfume,
0.2% protease,
10.0% zeolite,
15.0% layer silicate,
5.0% fatty acid condensate, and the balance, sodium sulfate, water and salts.

The fatty acid condensate used was the fatty acid condensate prepared in accordance with Example I.

Washing tests were carried out with the detergent composition described above in the same way as in Example I.

COMPARISON EXAMPLE I

A mixture of the following composition, in % by weight, was prepared. In the following, "EO" stands for moles of ethylene oxide.

7.0% alkyl benzenesulfonate,
4.0% $C_{15}$–$C_{18}$ fatty alcohol-5 EO/$C_{16}$–$C_{18}$ fatty alcohol-10 EO (50 : 50),
1.0% $C_{12}$–$C_{18}$ fatty acid, Na salt,
1.4% polycarboxylic acid,
3.5% waterglass, ratio $Na_2O$: $SiO_2$=3.35,
0.7% cellulose ether mixture,
0.3% perfume,
0.2% protease,
16.0% tripolyphosphate,
5.0% fatty acid condensate, and the balance, sodium sulfate, water and salts.

The fatty acid condensate used was the fatty acid condensate prepared in accordance with Example I.

Washing tests were carried with the detergent composition described above in the same way as in Example I.

COMPARISON EXAMPLE II

A mixture of the following composition, in % by weight, was prepared. In the following, "EO" stands for moles of ethylene oxide.

7.0% alkyl benzenesulfonate,
4.0% $C_{15}$–$C_{18}$ fatty alcohol-5 EO/$C_{16}$–$C_{18}$ fatty alcohol-10 EO (50 : 50),
1.0% $C_{12}$–$C_{18}$ fatty acid, Na salt,
1.4% polycarboxylic acid,
3.5% waterglass, ratio $Na_2O$: $SiO_2$=3.35,
0.7% cellulose ether mixture,
0.2% perfume,
0.2% protease,
16.0% tripolyphosphate,
15.0% layer silicate, and the balance, sodium sulfate, water and salts.

Washing tests were carried out with the detergent composition described above in the same way as in Example I.

In the washing tests, it was found that neither a formulation based on layer silicate nor a formulation based on fatty acid condensate was capable of achieving the same softness level as the detergent compositions according to the invention. The softness levels achieved with the detergent compositions according to the invention are higher than the combined softness levels of the two Comparison Examples.

Accordingly, the effect of the combination according to the invention could be demonstrated both in phosphate-reduced detergent compositions and in phosphate-free detergent compositions.

We claim:

1. A granular, phosphate-reduced, builder-containing detergent composition containing the combination consisting essentially of;

(a) from about 4 to about 20% by weight of natural layer silicate, and (b) from about 0.3 to about 10% by weight of fatty acid condensate obtained by reaction of a fatty acid triglyceride with a hydroxyalkyl polyamine, based on the weight of said detergent composition wherein the ratio by weight of said layer silicate to said fatty acid condensate is between 5:1 and 1:2.

2. A detergent composition as in claim 1 wherein said natural layer silicate is present in an amount of from about 5 to about 15% by weight, based on the weight of said detergent composition.

3. A detergent composition as in claim 1 wherein said layer silicate is selected from the group consisting of montmorillonite, volchonskoite, neutronite, hectorite, smectite and sauconite.

4. A detergent composition as in claim 1 wherein said fatty acid condensate is present in an amount of from about 1 to about 6% by weight, based on the weight of said detergent composition.

5. A detergent composition as in claim 1 wherein said fatty acid condensate has been prepared by reacting a triglyceride of a higher fatty acid containing from 8 to 24 carbon atoms and at least 50% of which contain from 16 to 24 carbon atoms per fatty acid group with a hydroxyalkyl polyamine containing at least 2 hydrogen atoms attached to nitrogen, with the proviso that, for each primary and secondary amino group and each hydroxyl group present in said hydroxyalkyl polyamine, $\frac{1}{3}$ mole of fatty acid triglyceride is reacted per mole of hydroxyalkyl polyamine.

6. A detergent composition as in claim 1 wherein said fatty acid condensate has been prepared by reacting 1 mole of hardened tallow with 1 mole of hydroxyethyl ethylenediamine.

7. A detergent composition as in claim 1 wherein said composition contains less than 20% by weight of phosphate, based on the weight of said detergent composition.

8. A detergent composition as in claim 1 wherein said composition is phosphate-free.

9. A granular detergent composition containing the combination consisting essentially of;

(a) from about 4 to about 20% by weight a natural layer silicate, and (b) from about 0.3 to about 10% by weight of a fatty acid condensate obtained by reaction of a fatty acid triglyceride with a hydroxyalkyl polyamine, in a weight ratio of from about 5:1 to about 1:2, respectively.

10. A process for softening a fabric comprising contacting said fabric with a solution of a phosphate-reduced, builder-containing detergent composition containing the combination consisting essentially of;

(a) from about 4 to about 20% by weight of natural layer silicate, and (b) from about 0.3 to about 10% by weight of fatty acid condensate obtained by reaction of a fatty acid triglyceride with a hydroxyalkyl polyamine, based on the weight of said detergent composition wherein the ratio by weight of said layer silicate to said fatty acid condensate is between 5:1 and 1:2.

11. A process as in claim 10 wherein said natural layer silicate is present in an amount of from about 5 to about 15% by weight, based on the weight of said detergent composition.

12. A process as in claim 10 wherein said layer silicate is selected from the group consisting of montmorillonite, volchonskoite, neutronite, hectorite, smectite and sauconite.

13. A process as in claim 10 wherein said fatty acid condensate is present in an amount of from about 1 to about 6% by weight, based on the weight of said detergent composition.

14. A process as in claim 10 wherein said fatty acid condensate has been prepared by reacting a triglyceride of a higher fatty acid containing from 8 to 24 carbon atoms and at least 50% of which contain from 16 to 24 carbon atoms per fatty acid group with a hydroxyalkyl polyamine containing at least 2 hydrogen atoms attached to nitrogen, with the proviso that, for each primary and secondary amino group and each hydroxyl group present in said hydroxyalkyl polyamine, 1/3 mole of fatty acid triglyceride is reacted per mole of hydroxyalkyl polyamine.

15. A process as in claim 10 wherein said fatty acid condensate has been prepared by reacting 1 mole of hardened tallow with 1 mole of hydroxyethyl ethylenediamine.

16. A process as in claim 10 wherein said composition contains less than 20% by weight of phosphate, based on the weight of said detergent composition.

17. A process as in claim 10 wherein said composition is phosphate-free.

18. A process for softening a fabric comprising contacting said fabric with a solution containing the combination consisting essentially of;

(a) from about 4 to about 20% by weight of a natural layer silicate, and (b) from about 0.3 to about 10% by weight of a fatty acid condensate obtained by reaction of a fatty acid triglyceride with a hydroxyalkyl polyamine, in a weight ratio of from about 5:1 to about 1:2, respectively.

* * * * *